United States Patent [19]

Doudet

[11] 4,317,352

[45] Mar. 2, 1982

[54] CUTTING DEVICES FOR EXTRUSION PRESSES

[75] Inventor: Michèl Doudet, Epône, France

[73] Assignee: Secim, Courbevoie, France

[21] Appl. No.: 111,163

[22] Filed: Jan. 10, 1980

[30] Foreign Application Priority Data

Jan. 31, 1979 [FR] France ..... 79 02440

[51] Int. Cl.[3] ..... B21C 35/04

[52] U.S. Cl. ..... 72/255

[58] Field of Search ..... 72/255, 263

[56] References Cited

U.S. PATENT DOCUMENTS 2,914,171 11/1959 Hoffmann et al. ..... 72/255

FOREIGN PATENT DOCUMENTS 1914198 10/1969 Fed. Rep. of Germany ..... 72/263

1490043 6/1967 France ..... 72/255

*Primary Examiner*—Lowell A. Larson

*Attorney, Agent, or Firm*—Pollock, Vande Sande & Priddy

[57] ABSTRACT

A cutting device for a direct extrusion press is intended to shear the residue remaining in the press cylinder after extrusion of the useful part of the billet to separate the residue from the extruded product. The device comprises a plane blade which is displaceable in a direction perpendicular to the extrusion axis between operative and inoperative positions and is guided in its displacement by guide means and displaced by drive means both of which are mounted on the slide block of the press.

5 Claims, 6 Drawing Figures

CUTTING DEVICES FOR EXTRUSION PRESSES

The invention relates to a cutting device for a press for the direct extrusion of metal billets and particularly but not exclusively for the extrusion of aluminium billets.

A press used for the extrusion of aluminium billets comprises a longitudinally displaceable cylinder, in which the billet is placed at the start of the extrusion operation and inside which the rammer, which is connected to thrust means, acts in order to extrude the billet through a die arranged transversely relative to the cylinder.

These presses frequently comprise a transversely displaceable slide block, which carries the die and is guided in its displacement in the bed of the press, by means of a jack, between an operative position opposite a thrust plate carried by the bed of the press and an inoperative position in which the die is released laterally relative to the axis of extrusion of the press, for maintenance or replacement of the die.

At the end of the extrusion operation, when the useful part of the billet has been pushed by the rammer through the die to produce the extruded product, a residue of metal remains in the cylinder and must be separated from the extruded product before the latter is ejected.

In order to carry out this operation, a shear blade is generally used, which blade is mounted on the bed of the press, above the operative position of the die, and can move between an inoperative position and an operative position in which the residue is sheared by virtue of guide means integral with the bed of the press and by virtue of drive means for displacing the blade and enabling it to exert a shear force.

In the devices used hitherto, the reaction of the shear force on the frame is transmitted via a very large number of components, including the slide block which carries the die, and this detracts from the rigidity of the unit and makes it necessary to design these components in accordance with the required shear force.

Furthermore, the distance between the support of the shearing device, on the bed of the press, and the residue to be sheared is large, because it is necessary to create a sufficient gap to position the cylinder inside the cradle for its support and displacement, as a result of which the shearing device is located away from the axis of extrusion.

These disadvantages give rise to poor guiding of the blade of the shearing device, as a result of which the drive element driving the shearing blade, for example the jack rod transmitting the drive force, is made oversize because this rod is not guided and effects a movement of large amplitude in order to bring the blade into its operative position.

According to the invention there is provided a cutting device for a press for the direct extrusion of metal billets, the press comprising a longitudinally movable cylinder for receiving a billet, and a bed in which is mounted a transversely displaceable slide block which carries a die, the cutting device being adapted to shear the residue remaining in the cylinder after extrusion of the useful part of a billet to separate the residue from the extruded product, and comprising a plane blade which is displaceable in a direction perpendicular to the axis of extrusion between an inoperative position away from the die and from the product during extrusion and an operative position in which cutting takes place when the cylinder has been moved away from the die at the end of an extrusion operation, guide means for guiding said blade in its displacement and drive means for displacing said blade and for applying a cutting force to said blade, said guide means and the drive means being carried by the slide block.

An embodiment of a cutting device according to the invention, associated with a press for direct extrusion, will now be described, by way of example only, with reference to the accompanying drawings and by comparison with a cutting device according to the prior art.

Figure 1:
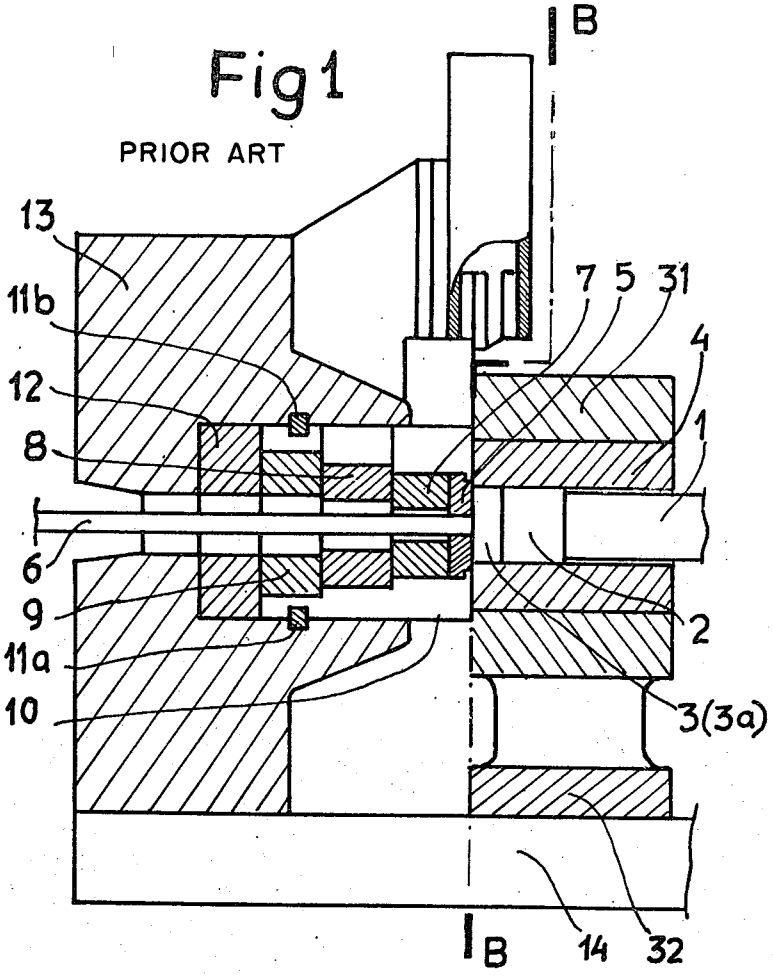
Fig 1 PRIOR ART
FIG. 1 shows part of a direct extrusion press, in section along the line A—A of FIG. 2 passing through the axis of extrusion, which press comprises a cutting device according to the prior art, the components of the press being in their position corresponding to the end of an extrusion operation.

FIG. 1 shows a known direct extrusion press which comprises a rammer 1 provided with a thrust disc 2 for transmitting the thrust to the rear part of a billet 3 which is shown at the end of extrusion and which has been converted by extrusion through a die 5 into an extruded product 6.

The die 5 bears, via bearing plates 7, 8 and 9, on a thrust plate 12 fixed inside the bed 13 of the press. The die 5 and the bearing plates 7, 8 and 9 are arranged in a slide block 10 which is movable transversely, relative to the bed 13 of the press, by virtue of keys 11*a* and 11*b* introduced into grooves provided in the bed 13.

Figure 2:
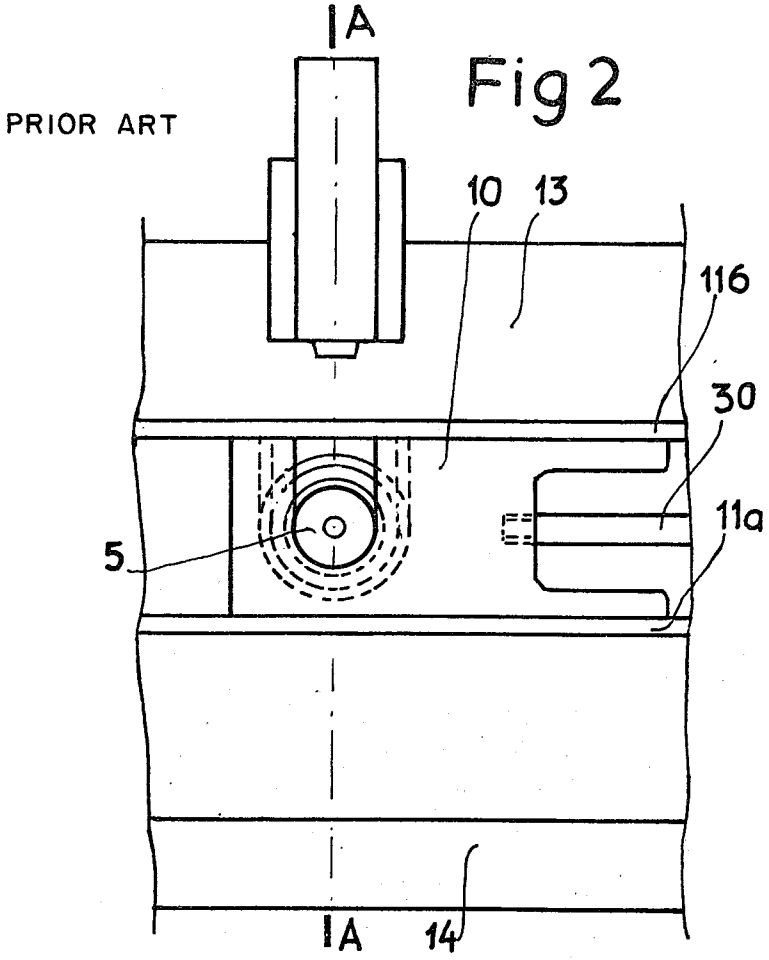
Fig 2 PRIOR ART
FIG. 2 is a view on the line B—B of FIG. 1.

As shown in FIG. 2, the slide block 10 can be brought into its operative position, as shown in FIGS. 1 and 2, or into its inoperative position, by a transverse movement by virtue of a jack, the rod 30 of which is fixed to one side of the slide block 10.

The cylinder 4 is carried by a cradle 31 integral with a carriage 32 which moves in the direction of extrusion on the plinth 14 of the press, on which plinth the bed 13 is also fixed.

The general displacement of the cradle 31 makes it possible to release that part 3*a* of the billet 3 which has not been extruded in order to separate the part 3*a* from the extruded product 6.

Figure 3:
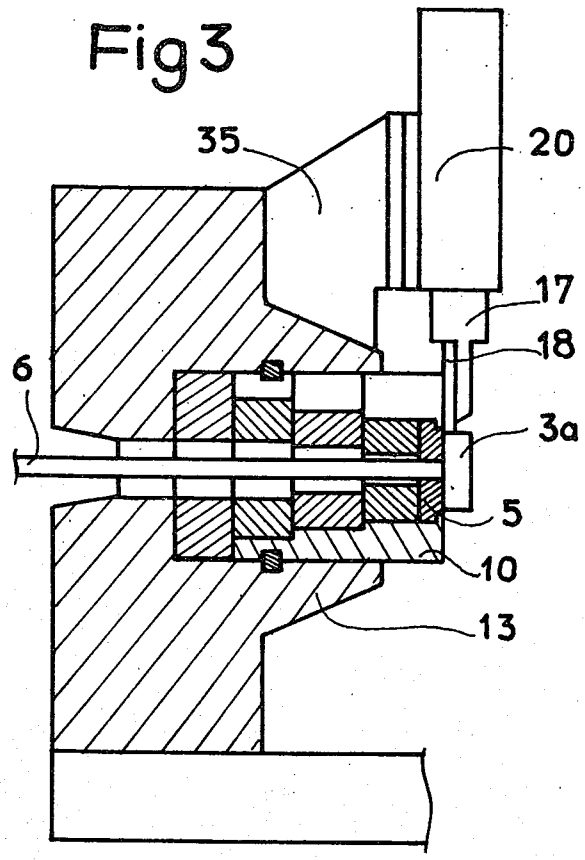
PRIOR ART Fig 3
FIG. 3 shows the same press, a section through a vertical plane passing through the axis of extrusion, during a shearing operation on the residue.

This part 3*a* of the billet, which is referred to as the residue, is separated from the extruded product 6 at the end of extrusion and after retracting the cylinder and its cradle, by virtue of a cutting device, as shown in FIG. 3.

This cutting device comprises a blade 18 fixed to the rod 17 of a jack 20 which ensures guiding, displacement and the application of the cutting force to the blade.

The jack 20 is itself fixed to a shear support 35 which is firmly fixed to the bed 13.

In FIG. 3 the blade is shown in its operative cutting position and it is clear that this blade effects a displacement of large amplitude in order to shear the residue 3*a*, and that, consequently, the rod of the jack has to extend from the body of the jack over a fairly large distance, so that the jack rod must be designed to withstand bending during the shearing operation. The rod must therefore be oversize and this complicates the manufacture of the cutting device and renders it more expensive.

Furthermore, it is seen that the chain of actions and reactions during the shearing operation is completed via a large number of components. There are, after the blade 18 which effects shearing, the extruded product 6, the die 5, the slide block 10, the bed 13, the jack support 35, and the jack 20, the rod 17 of which carries the blade 18.

The rigidity of the unit is not therefore very great and, consequently, the guiding of the blade is not very good. Furthermore, the displacement of the blade is necessarily large since the retracted inoperative position of the blade in the body of the jack, as shown in FIG. 1, is a long way from the extruded product because of the bulk of the cradle 31 carrying the cylinder 4.

A cutting device, according to the invention, in which these disadvantages are overcome, will now be described with reference to FIGS. 4, 5 and 6.

In these Figures, reference numbers corresponding to the reference numbers used in the description of FIGS. 1, 2 and 3 designate the same elements.

Figure 4:
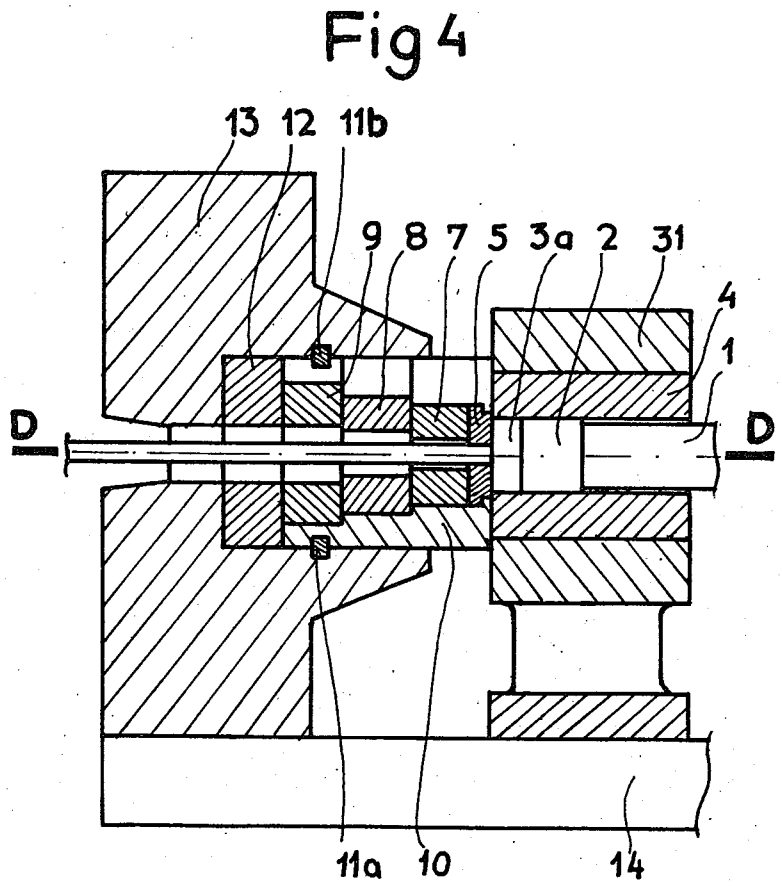
FIG. 4 shows, in an analogous view to that of FIG. 1, a press provided with an embodiment of a cutting device according to the invention.

In FIG. 4, it is seen that the cutting device located above the slide block 10, on the bed or frame 13, has been omitted, and that, consequently, the upper part of the bed of the press is completely clear, with the result that the movement of the cradle carrying the cylinder is not and cannot be hindered in any way.

Figure 5:
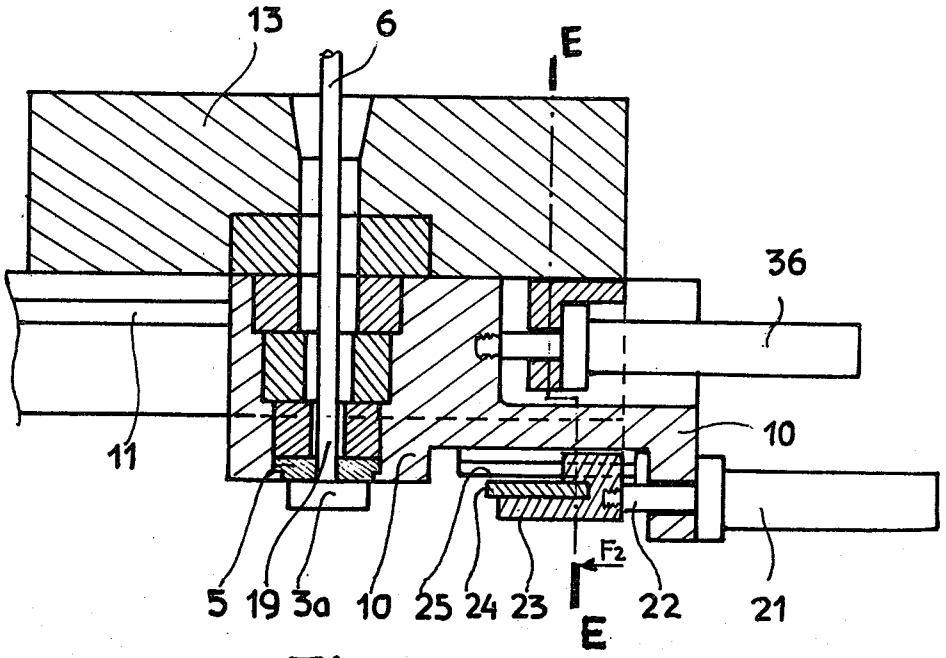
FIG. 5 is a section on the line D—D of FIG. 4.
Figure 6:
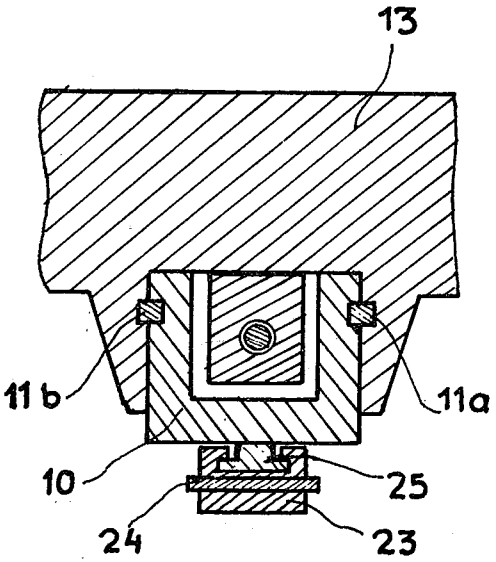
FIG. 6 is a section on the line E—E of FIG. 5.

FIGS. 5 and 6 show the arrangement of the cutting blade, of its guide means and of its drive means for its displacement and for the application of a force thereto.

The blade 24 is carried by a blade holder 23 fixed to the end of the rod 22 of a jack 21, the body of which is fixed to the slide block 10.

The blade holder 23 is movable in the transverse direction of the slide block on a slide 25 integral or fast with the slide block, and is moved when the rod 22 of the jack 21 moves relative to the body of the jack.

As shown in FIG. 6, the slide 25 is formed by a part with a T-shaped cross-section. The blade holder 23 possesses a correspondingly shaped sliding surface which makes it possible both to hold and to guide the blade holder and the blade, relative to the slide block 10, during displacement of the blade in the transverse direction.

The jack 21 is separate from the jack 36 which permits transverse diplacement of the slide block 10 on the guide keys 11*a* and 11*b*. The body of this jack 36 is made integral with the frame 13.

The operation of the above described cutting device becomes clearly apparent when considering FIG. 5, in which the press is shown at the end of an extrusion operation, when the cylinder 4 has been moved away from the die 5 by longitudinal movement along its cradle 31.

The residue 3*a* is to be separated from the extruded product 6 by shearing, and to do this, it suffices to supply the shear jack 21 so as to cause the rod to be extended. This causes displacement of the blade holder 23 and of the blade 24 towards the residue 3*a* until contact with the residue 3*a* takes place.

Shearing then starts by means of the thrust of the rod 22 on the blade holder 23, the blade being in contact with the residue and the extruded product, in order to effect shearing and separation of the residue from the extruded product.

It is seen that, during its entire displacement and during the shearing operation, the blade holder 23 remains held and guided against the slide block 10, and that the rod 22 of the jack 21 does not therefore undergo bending and buckling. Thus, it is possible to use a smaller jack than the jacks used in the known devices.

With the slide 25 extended to a point close to the die and to the residue to be sheared, the free path of the blade 24, for bringing it into contact with the residue and for effecting shearing, is considerably reduced, relative to the free path of the corresponding blade of the device shown in FIGS. 1, 2 and 3. If desired, this free path of the blade could be substantially totally eliminated by extending the slide to a sufficient length.

Furthermore, the chain of actions and reactions, during the shearing operation, is completed via a smaller number of components than in the case of the known devices. In fact, this chain is completed via the blade 24, the extruded product 6, the die 5, the slide block 10, and the jack 21, the rod 22 of which is fast with the blade holder 23.

Transmission of the action and reaction forces between the bed of the press and the slide block is thus avoided.

The invention is not restricted to the embodiment which has now been described; on the contrary, it includes all the variants thereof and points of detail can be modified without thereby going outside the scope of the invention.

Thus, the elements for guiding and holding the blade holder on the slide block have been described in the form of a profiled slide and of a blade holder possessing corresponding sliding surfaces, the attachment of the blade holder to the slide block being achieved by means of a mortise and tenon arrangement, but any other form of slide or any other means for guiding and holding the blade holder on the slide block can be used.

The drive element required for displacing the blade and for applying the shear force has been described in the form of a jack, but it will be apparent that any other drive element which displaces the blade towards the extruded product along the guide elements, and which is considered capable of applying the shear force, can be substituted for the jack.

While, in the embodiment which has been described, the arrangement of the blade and that of its guide elements are such that the blade is displaced horizontally and in a direction transverse to the extrusion axis, it will be apparent that the displacement of the blade and the shearing of the residue can equally be achieved by a movement in any other direction perpendicular to the axis of extrusion by fixing appropriate guide elements to the slide block.

The guide elements can be constructed not only in the form of slides but also in any other form such as a rack, a bearing and guiding surface for rollers, or a ball-type slide.

Finally, the above described cutting device is applicable not only to presses for the direct extrusion of aluminium billets but also to presses for the direct extrusion of any other metal billet.

What is claimed is:

1. A cutting device for a press for the direct extrusion of metal billets, the press comprising a longitudinally movable cylinder for receiving a billet, and a bed in which a transversely displaceable slide block is mounted, the slide block carrying a die, said cutting device being arranged to shear the residue remaining in the cylinder after extrusion of the useful part of a billet, to separate the residue from the extruded product, and comprising:

a plane blade which is displaceable in a direction perpendicular to the axis of extrusion between an inoperative position away from the die and from the product during extrusion and an operative position in which cutting takes place when the cylinder has been moved away from the die at the end of an extrusion operation;

guide means for guiding said blade in its displacement;

drive means for displacing said blade and for applying a cutting force to said blade; and wherein said guide means and said drive means are mounted on the slide block, end parts of said guide means being disposed near the die to guide said blade perfectly during the cutting operation.

2. A cutting device according to claim 1, wherein said drive means comprises a jack, the body of which is fixed to the slide block and the rod of which is connected to support means supporting said cutting blade.

3. A cutting device according to claim 1 or claim 2, wherein said guide means comprises a profiled slide fixed to the slide block, and correspondingly shaped sliding surfaces on a or said support means supporting said cutting blade, said sliding surfaces cooperating with said profiled slide in the displacement of said blade by sliding relative to the slide block, and constituting with the profiled slide retaining means of the mortise and tenon type.

4. A cutting device according to claim 1, wherein said guide means are arranged horizontally and in the transverse direction on the slide block.

5. A cutting device according to claim 3, wherein said guide means are arranged horizontally and in the transverse direction on the slide block.

* * * * *